US009808942B2

(12) United States Patent
Wang

(10) Patent No.: US 9,808,942 B2
(45) Date of Patent: Nov. 7, 2017

(54) KNIFE WITH REPLACEABLE BLADE

(71) Applicants: Hangzhou Great Star Tools Co., LTD, Hangzhou, Zhejiang Province (CN); Hangzhou Great Star Industrial Co., LTD, Hangzhou, Zhejiang Province (CN)

(72) Inventor: Weiyi Wang, Hangzhou (CN)

(73) Assignees: HANGZHOU GREAT STAR TOOLS CO., LTD., HANGZHOU (CN); HANGZHOU GREAT STAR INDUSTRIAL CO., LTD., HANGZHOU (CN)

( * ) Notice: Subject to any disclaimer, the term of this patent is extended or adjusted under 35 U.S.C. 154(b) by 23 days.

(21) Appl. No.: 14/370,008

(22) PCT Filed: Mar. 12, 2014

(86) PCT No.: PCT/CN2014/073280

§ 371 (c)(1),
(2) Date: Feb. 23, 2015

(87) PCT Pub. No.: WO2015/135154

PCT Pub. Date: Sep. 17, 2015

(65) Prior Publication Data

US 2015/0258696 A1 Sep. 17, 2015

(51) Int. Cl.
*B26B 5/00* (2006.01)

(52) U.S. Cl.
CPC ..... *B26B 5/001* (2013.01); *B26B 5/00* (2013.01)

(58) Field of Classification Search
CPC ..... B26B 5/00; B26B 5/001
See application file for complete search history.

(56) References Cited

U.S. PATENT DOCUMENTS 4,005,525 A 2/1977 Gringer
6,163,963 A * 12/2000 Huang ..... B26B 5/001 30/162
6,553,674 B1 4/2003 Budrow
(Continued)

FOREIGN PATENT DOCUMENTS

CN 101564844 10/2009
CN 102756384 10/2012
(Continued)

OTHER PUBLICATIONS

English Translation of DE29711084.*
PCT Search Report dated Nov. 21, 2014 for PCT/CN2014/073280, 2 pages.

*Primary Examiner* — Jennifer Swinney
(74) *Attorney, Agent, or Firm* — Seed IP Law Group LLP

(57) ABSTRACT

The present invention publishes a knife with a replaceable blade, comprising a housing, a cover arranged on the housing and a blade carrier arranged between the housing and the cover, characterized in that, a blade which can move between an extended position and a retracted position is installed on the blade carrier, and a blade cartridge carrier is arrange around the periphery of a position adjacent to the retracted position of the blade, the blade cartridge carrier is provided with an internal space of a blade shape to place spare blades. Wherein, the cover can be connected with the housing in an open type to fix the blade carrier between the cover and the housing.

19 Claims, 3 Drawing Sheets

(56) References Cited

U.S. PATENT DOCUMENTS

| | | | | |
|---|---|---|---|---|
| 6,966,113 | B2 * | 11/2005 | Fossella | B26B 5/001 30/162 |
| 2002/0029480 | A1 * | 3/2002 | Lin | B26B 5/001 30/125 |
| 2004/0163261 | A1 * | 8/2004 | Lin | B26B 5/001 30/162 |
| 2005/0188541 | A1 * | 9/2005 | Brown | B26B 5/001 30/162 |
| 2005/0193566 | A1 * | 9/2005 | Brown | B26B 5/001 30/162 |
| 2005/0283983 | A1 * | 12/2005 | Huang | B26B 5/001 30/162 |
| 2006/0080842 | A1 * | 4/2006 | Schmidt | B26B 5/001 30/162 |
| 2007/0107232 | A1 * | 5/2007 | Green | B26B 5/003 30/162 |
| 2007/0227012 | A1 | 10/2007 | Constantine et al. | |
| 2009/0223063 | A1 * | 9/2009 | Hallquist | B26B 5/001 30/162 |

FOREIGN PATENT DOCUMENTS

| | | | | |
|---|---|---|---|---|
| CN | 202846541 | | 4/2013 | |
| CN | 203792360 | | 8/2014 | |
| DE | 4009905 | A1 * | 10/1991 | B26B 5/00 |
| TW | DE 29711084 | U1 * | 9/1997 | B26B 5/001 |

* cited by examiner

KNIFE WITH REPLACEABLE BLADE

FIELD OF THE INVENTION

The invention relates to a knife, and more specifically relates to a knife with a replaceable blade, and which can be automatically replaced.

DESCRIPTION OF THE PRIOR ART

For knifes needing thin blades such as a unity knife, the blades are most easily damageable in use, and how to replace the blades safely and swiftly is a problem needed to be solved. At present, a knife with an automatically replaceable blade generally includes a removable blade carrier structure with blades, and a spare blade cartridge for placing spare blades, which is in the same transverse direction as the blade and at the same position in a retracted state. When the blade needs to be replaced, automatic blade loading can be realized as long as the longitudinal position of the blade is automatically transformed to the position of the used blade, then the blade is replaced.

The U.S. Pat. No. 6,553,674 disclosed a utility knife with a spare blade cartridge, and the blades of which are automatically replaceable. Wherein a single blade cartridge door is arranged on the cover at the position of the blade cartridge, and the blade cartridge door connects with the housing of the knife through the pivot on the top, the blade cartridge is provided with a spring lock, when the spring lock is opened, the blade cartridge door is opened along the pivot. The defect of this design is that the blade cartridge door can only open to around 90 degrees because there is a need of keeping the blade cartridge door pivot and the housing of knife engaged closely and the gaps between the pivot of the blade cartridge door and the housing of the knife shall as small as possible, therefore it is difficult to place and remove a spare blade, and easy to hurt the users as the blade is thin, in addition, the design of the spring lock is space occupied which makes the structure not compact enough. Therefore a utility knife with spare blades that can be placed conveniently and safely is needed in the market.

SUMMARY OF THE INVENTION

The objective of the present invention is to provide a knife, the spare blades of which are stored in handle, its cover can be integrally opened, and the blade can be replaced conveniently and safely.

The objective of the present invention is to provide a knife, the structure of which for replacing the blade is simple, and the blade can be replaced conveniently and swiftly.

In order to achieve the above objectives, the present invention provides a knife with replaceable blade including a housing, a cover arranged on the housing and a blade carrier arranged between the housing and the cover, characterized in that, a blade which can move between an extended position and a retracted position is installed on the blade carrier, and a blade cartridge carrier is arranged around the periphery of a position adjacent to retracted position of the blade, the blade cartridge carrier is provided with an internal space of a blade shape to place spare blades. Wherein, the cover can be connected with the housing in an open type to fix the blade carrier between the cover and the housing.

The housing and the cover are hinged together through a pivot.

The housing is provided with a front portion and a rear portion, the blade carrier is arranged on the front portion to install the blade, the rear portion is set with a receiver to place the spare blades, and the cover encloses the blade carrier and the receiver into the housing.

The blade carrier located on the front portion of the housing includes a blade frame which can move along the blade carrier to enable a blade arranged in the blade frame to transform from a position out of the housing to a position receive in the housing.

The blade carrier further includes a sliding controlling member, and the sliding controlling member includes a handheld portion located in the external portion of the housing and a connection portion extended from the bottom of the handheld portion to connect with the blame frame.

The connection portion divides into two portions, a top portion and a bottom portion, the bottom portion is provided with lateral protuberance towards the direction of the housing, a spring is arranged between a bottom of the bottom portion and a contact surface of the blade frame, the housing is provided with spaced recesses within the stroke range of the sliding controlling member, and the lateral protuberances are located in the recesses.

The blade is provided with a locking part, the locking part is a notch or a through hole on the back of blade, and the blade is detachably fixed on the blade frame via the locking part.

The blade carrier further includes a blade lock set at the other side of the blame frame versus the blade, a strike for clamping into the internal of locking part of the blade and a pushing part for receiving external force to make the blade lock away from the direction of the blade are arranged on the blade lock.

The housing is provided with an unlocking member at a position corresponding to the pushing part of the blade lock, and the unlocking member includes a spring to exert force to the pushing part.

The blade carrier further includes blade loading member which is a magnetic element arranged on the blade flame.

A leaf spring is arranged at an inner side of the cover, and the position of the leaf spring corresponds to the position of spare blades stored in an inner space of the blade cartridge carrier.

A switch mechanism is arranged on the cover to control the opening and closing of the cover and the housing.

The switch mechanism includes a trigger member located at an outside of the cover and a contacting member connected with the trigger member, when the switch mechanism is at closed state, the contacting member is coordinately fixed with the housing, and when the switch mechanism is at open state, the contacting member is separated with the housing, thereby the cover is separated with the housing.

The fixed and separated state of the contacting member with the housing can be controlled by pressing, turning or pushing the trigger member.

A through hole is arranged on the cover, the trigger member is arranged in the interior of the through hole, the switch mechanism further includes a switching spring, and the switching spring is arranged between a front internal wall of the through hole and the trigger member.

The contacting member is a hook member which extends from the bottom of the trigger member, a side slot is arranged at a position corresponding to the housing, and the side slot can accommodate and stick the hook portion of the hook member.

The trigger member includes one slot with two lateral walls and one pushing face, the two lateral walls are respectively provided with two holes, an axis pin goes through the center of the holes, a single pressure spring which is located between the slot and the pushing face is installed on the axis pin, an upper surface of the pushing face is used for pushing by hand, a lateral portion of the pushing face extends downward from two sides of the pushing face and has two ears, the ears respectively have cavities through which an axis pin can pass, thus the pushing face is installed on a top portion of the slot via the axis pin, a front portion of the pushing face is provided with a blocking portion which extends downward along the ears from a front edge of the pushing face, a stopping member which is located above the switch spring is arranged in the through hole of the cover, and the blocking portion is arranged at a position of the stopping member.

The switch mechanism further includes a fixing member by which the trigger member and the contacting member are fixed on the cover in the vertical direction.

An auxiliary spring is further arranged between the cover and the housing.

The receiver of the housing further includes an elastic holder which is installed on the housing beside the receiver, and an elastic end of the elastic holder extends to the top of the receiver, thereby the spare blades in the receiver can be fixed into the receiver.

In conjunction with the following drawings, the present inventive concept, the specific structure and the resulting technology effect are further described to fully understand the objects, features and effects of the present invention.

DETAILED DESCRIPTION OF THE PREFERRED EMBODIMENTS

Figure 1:
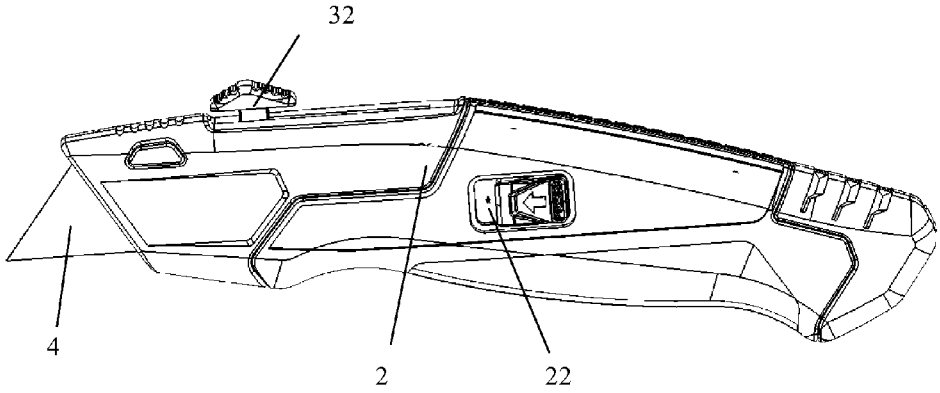
FIG. 1 is schematic of the external of one embodiment of the present invention.
Figure 2:
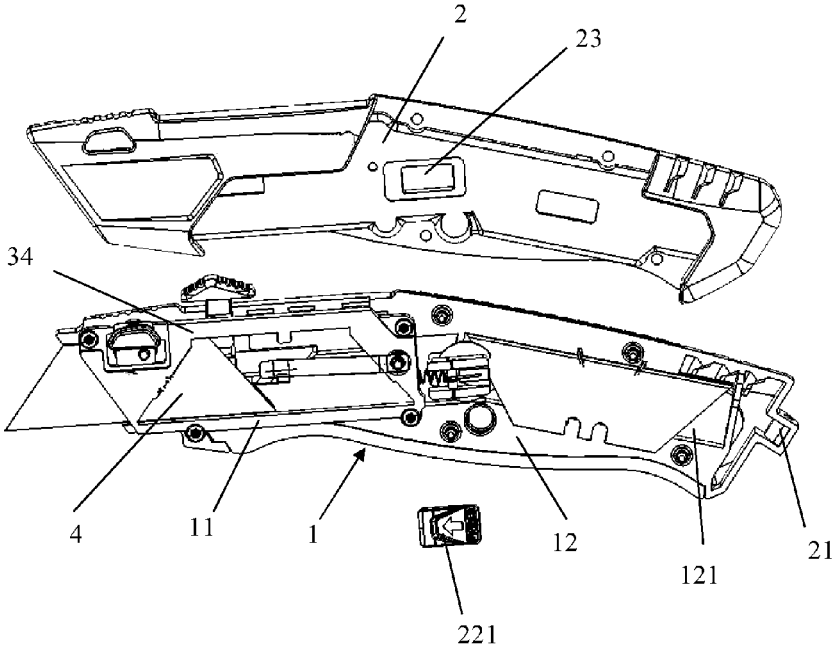
FIG. 2 is a view of one embodiment of the present invention with open cover.
Figure 3:
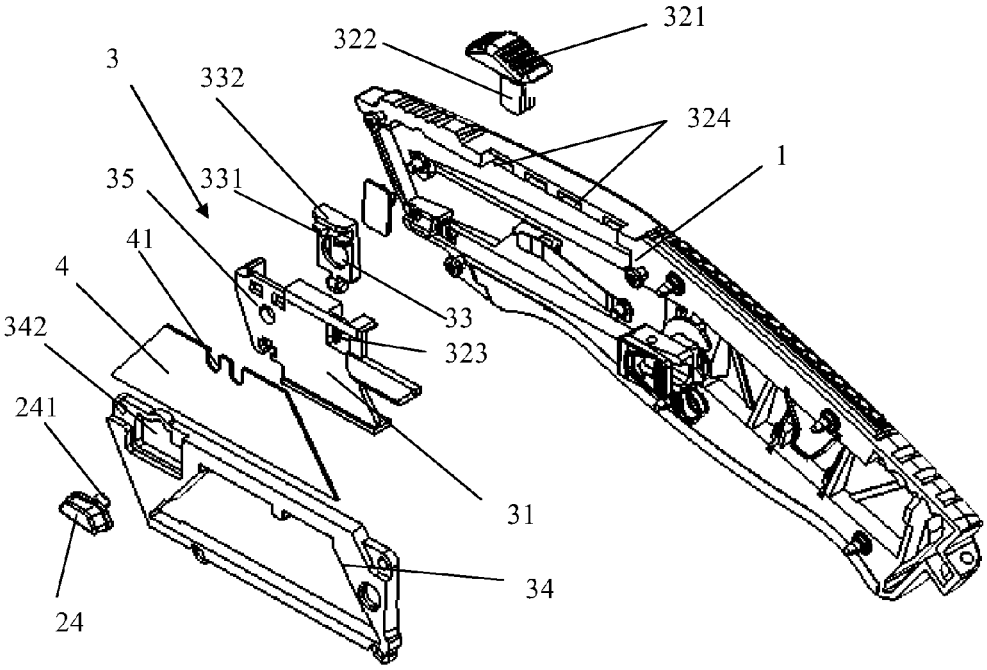
FIG. 3 is an explosive view of the rear portion of the housing of one embodiment of the present invention.

As shown in FIG. 1-3, a knife with a replaceable blade of the present invention including a housing 1, a cover 2 arranged on the housing 1 and a blade carrier 3 arranged between the housing and the cover, wherein, a blade 4 which can move between an extended position and a retracted position is installed on the blade carrier, and a blade cartridge carrier 34 is arranged around the periphery of a position adjacent to the retracted position of the blade, the blade cartridge carrier is provided with an internal space of a blade shape to place spare blades. Wherein, the cover 2 can be connected with the housing 1 in an open type to fix the blade carrier 3 between the cover 2 and the housing 1. In this way, when the cover is opened, the inner space of the blade cartridge carrier is exposed omnibearingly, and it is convenient to place the spare blades into the blade cartridge carrier 34, when the cover is closed, the knife can be used normally.

In one embodiment of the present invention, the housing is provided with a front portion 11 and a rear portion 12, the blade carrier 3 is arranged at the front portion to install a blade to use and to accommodate spare blades, the rear portion is set with a receiver 121 to place the spare blades, and the cover 2 can be integrally opened or only the part at the position of the blade carrier of which be opened. In one embodiment of the present invention, the cover 2 can be integrally connected with the housing 1 in an open type, and enclose the blade carrier 3 and the receiver 121 into the housing 1.

Wherein, the housing and the cover are hinged together through a pivot 21. Positions for hinging are located at the tail portions of the housing and the cover, and alternatively can be located in other positions, thereby the housing and the cover can be opened and closed along a position of the pivot for hinging. A switch mechanism 22 is arranged on the cover to control the opening and closing of the cover and the housing. The switch mechanism 22 is located on the position of the thumb of a hand that holds the knife and is convenient for use.

The blade carrier 3 located in the front portion of the housing includes a blade frame 31 and the blade is installed in the blade frame. The blade frame can move forward or backward along the blade carrier to enable the blade 4 installed in the blade frame 31 transforms from a position out of the housing to a position received in the housing. In other words, the blade frame can slide forward or backward along the blade carrier, thereby drive the blade installed in the blade frame to move forward or backward, and the blade extends out of the housing when moves forward and is received in the housing when moves backward.

Herein taking the mode of sliding for example, the blade carrier 3 further includes a sliding controlling member 32 which extends from the upper end of the blade frame 31 to an external side of the upper portion of the housing 1, which make it convenient for user to hold by hand and slide the blade carrier and the blade arranged on the blade carrier. The housing 1 is provided with a space within the stroke range of the sliding controlling member for movements of the sliding controlling member 32. The sliding controlling member 32 includes a handheld portion 321 located in the external of the housing and a connection portion 322 extends from the bottom of the handheld portion to connect with the blame frame. Moving the handheld portion 321 and the connection portion 322 thereof can drive the blade flame to move. Further, the connection portion divides into two portions, a top portion and a bottom portion, the bottom portion is provided with lateral protuberances towards to the direction of the housing, a spring 323 is arranged between the bottom of the bottom portion and the contact surface of the blade frame, the housing is provided with a spaced recesses 324 within the stroke range of the sliding controlling member. Under normal circumstances, because the lateral protuberances of the bottom portion of the connection portion are located in the recesses, the connection portion can only be located at the position of the recesses 324 within the stroke range of the sliding controlling member. When the handheld of the sliding controlling member is pressed down, the spring is compressed, at this time, the bottom portion with lateral protuberances moves downward to the bottom space with spaced recesses of the housing, therefore the bottom portion with lateral protuberance will not be blocked, at this time the sliding controlling member can move freely within the stroke range of housing. When no stress is downward exerted on the handheld 321 of the sliding controlling member 32, the connection portion 322 is bounced by the spring, at this time, the lateral portion of the recesses within the stroke range of sliding controlling member 32 of the housing will block the movement of the bottom portion of the connection portion, thus the sliding controlling member is unable to move at this time, thereby it can be ensured that the sliding controlling member will not slide the blade out carelessly to guarantee the safety of the user.

The blade is provided with a locking part 41, the locking part is a notch on the back of the blade, and also can be a through hole on the blade, the blade is detachably fixed on the blade frame via the locking part.

The blade carrier further includes a blade lock 33 set at the other side of the blame frame 31 versus the blade 4, a strike 331 for clamping into the internal of the locking portion 41 of the blade and a pushing part 332 for receiving external force to make the blade lock swing away from the direction of the blade are arranged on the blade lock 33. Under normal circumstances, the strike inserts into the locking portion of the blade through a hole at the corresponding position of the blade frame, thus the blade can move forward or backward along the blade frame and the blade lock. When the blade is needed to be replaced, the pushing part 332 is pressed down, at the same time the strike moves backwards along with the pushing part and aparts from the locking portion of the blade, thereby the blade can be unloaded from the blade frame. In this embodiment, at a state that the blade is stretched out, the pushing part 332 of the blade lock 33 moves forward along with the blade frame and the blade to reach out the state that that the blade is stretched out, at this time, the pushing part reveals through the hole 342 of blade cartridge carrier 34. When the pushing part is pushed, the blade can be unloaded by being pulled from the opening where the blade is stretched out.

The blade lock 33 is connected with a corresponding position at the blade carrier through a shaft at the bottom portion. At a state that the blade is slide out, the housing is provided with an unlocking member 24 including spring 241 at the position that corresponds to the pushing part of the blade lock. when pushing the spring from outside of the housing, the spring exerts a downward force on the pushing part through the hole 342 of the blade cartridge carrier, thus the strike moves downward along with the pushing part at the same time and aparts from the locking portion of the blade, at this time, the blade can be unloaded by be pulled toward the direction that the blade stretches out, so that spare blades can be replaced with new spare blades for using.

The position of the spare blades in inner space of the blade cartridge carrier is same with the position where the blade in use is retracted, in this way, when the blade in use is unloaded, a spare blade automatically reaches the blade cartridge carrier and can be used normally. In other words, when the blade frame is retracted, a spare blade is aligned with the arranging part of the blade frame where the blade is placed, so that after the blade on the blade carrier is taken away, the spare blade is at a position that can be directly moved to the placement part to achieve that the blade is automatically loaded.

The blade carrier also includes a blade loading member 35 which exerts force to the spare blade to let the spare blade toward the blade carrier, so as to exert force to the spare blade to move the spare blade to the placement part of the blade frame after the blade on the blade frame is taken away and to achieve that the blade is automatically loaded. In this embodiment, the blade loading member is a magnetic element fixed in the blade flame that exerts attraction to the spare blade to achieve that the blade is automatically loaded.

Figure 4:
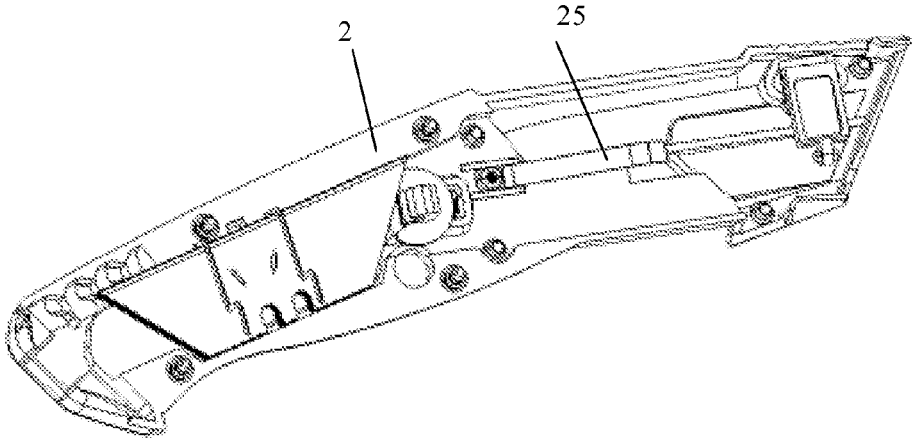
FIG. 4 is a schematic of the inner side of the cover of one embodiment of the present invention.

In one embodiment of the present invention, as shown in FIG. 4, the cover also includes a leaf spring 25 arranged at the inner side of the cover, the position of the leaf spring is corresponding to the position of the spare blades stored in an inner space of blade cartridge carrier, and the leaf spring exerts an inward force to the spare blades to guarantee the spare blades stayed in the blade cartridge carrier.

Figure 5:
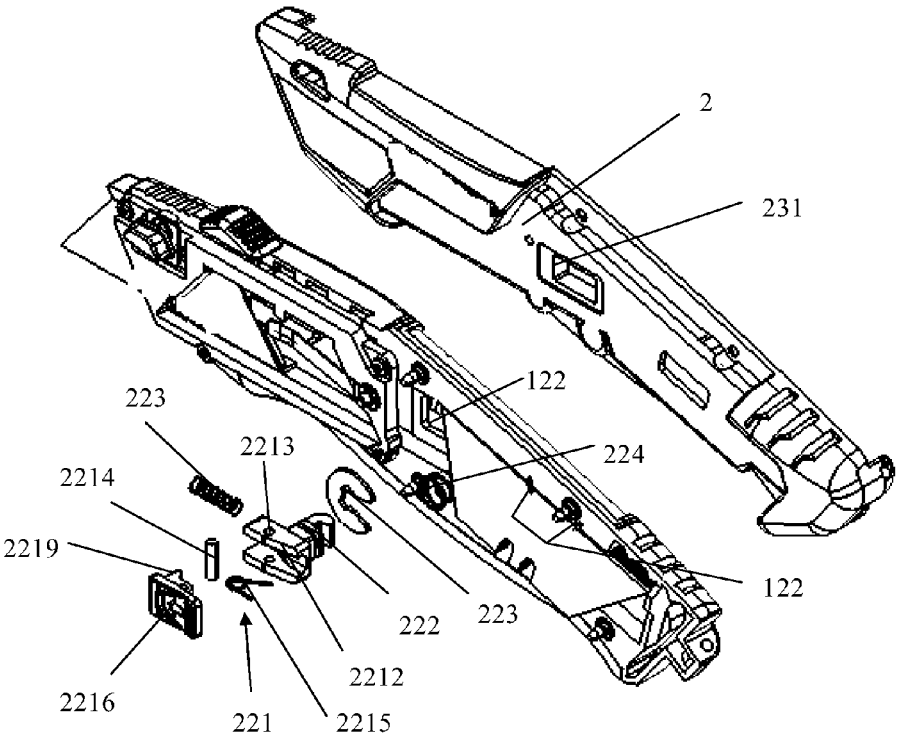
FIG. 5 is an explosive view of the front portion of one embodiment of the present invention.
Figure 6:
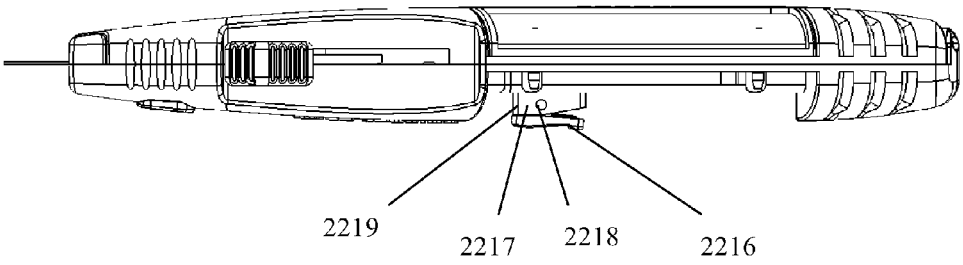
FIG. 6 is a top view of one embodiment of the present invention.

In this embodiment, as shown in FIGS. 5-6, the switch mechanism includes a trigger member 221 located at outside of the cover and a contacting member 222 connected with the trigger member, when the switch mechanism is at closed state, the contacting member 222 is coordinately fixed with the housing 1, and when the switch mechanism is at open state, the contacting member is separated with the housing, thereby the cover is separated with the housing.

The fixed and separated state of the contacting member 222 with the housing 1 can be controlled by pressing, turning or pushing the trigger member 221. The controlling of the fixed and separated state of the contacting member with the housing is achieved by pushing the trigger member in present invention. Specifically, a through hole 23 is arranged on the cover, and the switch mechanism further includes a switching spring 223, the trigger member 221 is arranged in the interior of the through hole 23, and the surface of the trigger member is slight higher than the surface of the cover 2, thus it is convenient for pushing by hand. The switching spring 223 is arranged between the front internal wall of the through hole 23 and the trigger member. The contacting member 222 is a hook member, which extends from the bottom of the trigger member, and a side slot 122 is arranged at a position corresponding to the housing, which can accommodate and stick the hook portion of the hook member. When the trigger member is pushed forward, the hook member emerges from the side slot of the housing, thus the cover is separated from the housing, and the trigger member is automatically reset by the switching spring. A bevel is arranged on the top of the hook member. When the cover and the housing are closed, the hook member is clamped into the side slot of the housing along the bevel on the top with the coordination of the switching spring, after that the trigger member is reset under the effect of the switching spring, and the coordination of the cover and the housing is accomplished.

Further, in order to prevent a worker from pushing the trigger member carelessly so as to open the cover and lead to serious consequences such as the emergence of the blade in it. The trigger member is designed to be a structure of spring clip, the trigger member 2211 includes one slot 2212 with two lateral walls and one pushing face 2216. The two lateral walls respectively have two holes 2213, an axis pin 2214 goes through the center of the hole, one pressure spring 2215 is installed on the axis pin, an upper surface of the pushing face is used for pushing by hand, a lateral portion of the pushing face extend downward from two sides of the pushing face and have two ears 2217, the ears respectively have cavities 2218 through which an axis pin can pass, thus the pushing face is installed on a top position of the slot via the axis pin. a front portion of the pushing face is provided with a blocking portion 2219 which extends downward along the ears from a front edge of the pushing face, a stopping member 231 is arranged in the through hole of the cover which is located above the switch spring, and the blocking portion is arranged at a position of the stopping member. Since the blocking portion is located at the position of the stopping member, even the trigger member is being pushed forward, it cannot move forward, and the switch mechanism cannot be used normally. When the rear portion of the pushing face is pressed downward, the rear portion of the pushing face moves downward as a result of overcoming the elasticity of the pressure spring, and the front portion of the pushing face raises along the axis pin, at this time, the blocking portion is located above the stopping member, and the contacting member can integrally move forward by pushing the trigger member, thereby the cover can be opened, after that, the trigger member is reset under the effect of the switching spring and the pushing face is reset under the effect of the pressure spring. Further, the stopping member extends out from the lateral wall of the through hole, and located above the switch spring. When the front portion of the trigger member raises since the rear portion of the trigger member is pressed down, the stopping member is located below the blocking portion of the trigger member. When no force is exerted on the rear portion of the trigger member, the front portion of which does not raise, at this time, the stopping member stops the forward movement of the blocking portion of the trigger member, thus the opening of the cover relative to the housing is blocked, so as to guarantee the safety of the user. A recess is arranged on the rear portion of the pushing face to make it convenient that putting a finger in to exert a downward force to the rear portion of the pushing face. In this embodiment, the hook member of the contacting member 222 and the bottom of the slot 2212 of the trigger member can be integrated as one, and also can be in fixed joint. The switch mechanism further includes a fixing member 223 which fixes the trigger member and the contacting member on the cover in the vertical direction, and the movement of trigger member does not be influenced in the transverse direction. Specifically, the fixing member is a clamping card, which clamps the contacting member into the bottom of the cover. The clamping card is a sheet member with a recess portion in the middle, and can accommodate part of the corresponding section of the trigger member. An auxiliary spring 224 is further arranged between the cover and the housing, which is located in the recess aside the contacting member of the cover, and bounces the cover and the housing away when the cover and the housing can be opened, making it convenient for use.

The receiver of the housing further includes an elastic holder 122 in this present invention, installed on the housing beside the receiver, an elastic end of the elastic holder extends to the top of the receiver, thereby the spare blades in the receiver can be fixed into the receiver. The receiver is provided with two slant support frames, so that the spare blades can be placed slantly in the receiver and make it convenient for storing and taking out. Furthermore the slant bottom portion of the receiver is used for storing the edge of the blade, so that to guarantee the safety of the user.

The foregoing described the preferred embodiments of the present invention. It should be understood that an ordinary one skilled in the art can make many modifications and changes according to the concept of the present invention without creative work. Therefore, any technical solutions obtained by a person skilled in the art depending on this technical concept according to this invention on the basis of the prior art through logical analysis, reasoning or limited experimental, should fall in the protection scope determined by the claims.

The invention claimed is:

1. A knife with a replaceable blade, comprising a housing, a cover arranged on the housing and a blade carrier arranged between the housing and the cover and slidable relative to the housing to move a blade between an extended position and a retracted position, and a blade cartridge carrier arranged adjacent and parallel to the blade carrier having a perimeter extending around a periphery of a position adjacent to the retracted position of the blade, the blade cartridge carrier having an internal space to receive spare blades, wherein the cover can be connected with the housing in an open type to fix the blade carrier between the cover and the housing;

a switch mechanism is arranged on the cover to control opening and closing of the cover and the housing, the switch mechanism comprising a trigger member located at an outside of the cover and a contacting member connected with the trigger member;

a through hole is arranged on the cover, and the trigger member is arranged in an interior of the through hole;

the trigger member comprising one pushing face and an axis pin, the pushing face capable of rotating around the axis pin, a front portion of the pushing face is provided with a blocking portion and a stopping member is arranged in the through hole of the cover; and when no force is exerted on the pushing face, the blocking portion is located at a position of the stopping member and the stopping member stops forward movement of the trigger member; and actuating the pushing face to overcome an elasticity of a pressure spring permits the pushing face to rotate around the axis pin and the blocking portion to rotate to a position above the stopping member to allow the trigger member to move forward.

2. The knife with a replaceable blade as claimed in claim 1, characterized in that, the housing and the cover are hinged together through a pivot.

3. The knife with a replaceable blade as claimed in claim 1, characterized in that, the housing is provided with a front portion and a rear portion, the blade carrier is arranged on the front portion to install the blade, the rear portion is set with a receiver to place the spare blades, and the cover encloses the blade carrier and the receiver into the housing.

4. The knife with a replaceable blade as claimed in claim 3, characterized in that, the blade carrier located on the front portion of the housing comprises a blade frame that can move along the housing to enable the blade installed in the blade frame to transform from a position out of the housing to a position received in the housing.

5. The knife with a replaceable blade as claimed in claim 4, characterized in that, the blade carrier further comprises a sliding controlling member, and the sliding controlling member comprises a handheld portion located on an exterior of the housing and a connection portion extended from a bottom of the handheld portion to connect with the blade frame.

6. The knife with a replaceable blade as claimed in claim 5, characterized in that, the connection portion divides into two portions, a top portion and a bottom portion, the bottom portion is provided with lateral protuberances towards the direction of the housing, a spring is arranged between a bottom of the bottom portion and a contact surface of the blade frame, the housing is provided with spaced recesses within the stroke range of the sliding controlling member, and the lateral protuberances are located in the recesses.

7. The knife with a replaceable blade as claimed in claim 5, characterized in that, the blade is provided with a locking part, the locking part is a notch or a through hole on the back of the blade, and the blade is detachably fixed on the blade frame via the locking part.

8. The knife with a replaceable blade as claimed in claim 7, characterized in that, the blade carrier further comprises a blade lock set at the other side of the blame frame versus the blade, a strike for clamping into the internal of the locking part of the blade and a pushing part for receiving external force to make the blade lock away from the direction of the blade are arranged on the blade lock.

9. The knife with a replaceable blade as claimed in claim 8, characterized in that, the housing is provided with an unlocking member at a position corresponding to the pushing part of the blade lock, and the unlocking member comprises a spring to exert force to the pushing part.

10. The knife with a replaceable blade as claimed in claim 9, characterized in that, the blade carrier further comprises a blade loading member which is a magnetic element arranged on the blade flame.

11. The knife with a replaceable blade as claimed in claim 10, characterized in that, a leaf spring is arranged at an inner side of the cover, and the position of the leaf spring corresponds to the position of the spare blades stored in an inner space of the blade cartridge carrier.

12. The knife with a replaceable blade as claimed in claim 1, characterized in that, when the switch mechanism is at a closed state, the contacting member is coordinately fixed with the housing, and when the switch mechanism is at an open state, the contacting member is separated with the housing, thereby the cover is separated with the housing.

13. The knife with a replaceable blade as claimed in claim 12, characterized in that, the switch mechanism further comprises a switching spring, and the switching spring is arranged between a front internal wall of the through hole and the trigger member.

14. The knife with a replaceable blade as claimed in claim 13, characterized in that, the contacting member is a hook member which extends from a bottom of the trigger member, a side slot is arranged at a position corresponding to the housing, and the side slot can accommodate and secure a hook portion of the hook member.

15. The knife with a replaceable blade as claimed in claim 14, characterized in that, the trigger member further comprises one slot with two lateral walls, the two lateral walls respectively have two holes, an axis pin goes through a center of the hole, a single pressure spring which is located between the slot and the pushing face is installed on the axis pin, an upper surface of the pushing face is used for pushing by hand, a lateral portion of the pushing face extends downward from two sides of the pushing face and has two ears, the ears respectively have cavities through which the axis pin can pass, thus the pushing face is installed on a top portion of the slot via the axis pin, the blocking portion extends downward along the ears from a front edge of the pushing face, the stopping member is located above the switch spring.

16. The knife with a replaceable blade as claimed in claim 15, characterized in that, the switch mechanism further comprises a fixing member by which the trigger member and the contacting member are fixed on the cover in a vertical direction.

17. The knife with a replaceable blade as claimed in claim 16, characterized in that, an auxiliary spring is further arranged between the cover and the housing.

18. The knife with a replaceable blade as claimed in claim 17, characterized in that, a receiver of the housing further comprises an elastic holder which is installed on the housing beside the receiver, and an elastic end of the elastic holder extends to a top of the receiver, thereby the spare blades in the receiver can be fixed into the receiver.

19. The knife with a replaceable blade as claimed in claim 1, characterized in that, a fixed state and a separated state of the contacting member with the housing can be controlled by pressing, turning or pushing the trigger member.

* * * * *